US010655076B2

(12) United States Patent
Sarkar et al.

(10) Patent No.: US 10,655,076 B2
(45) Date of Patent: May 19, 2020

(54) ASSORTED CO-STAGING AND COUNTER STAGING IN HYDROTREATING

(71) Applicant: INDIAN OIL CORPORATION LIMITED, Mumbai (IN)

(72) Inventors: Mainak Sarkar, Faridabad (IN); Darshankumar Manubhai Dave, Faridabad (IN); Ganesh Vitthalrao Butley, Faridabad (IN); Ramesh Karumanchi, Faridabad (IN); Arun Arangarasu, Faridabad (IN); Sarvesh Kumar, Faridabad (IN); Madhusudan Sau, Faridabad (IN); Debasis Bhattacharyya, Faridabad (IN); Sanjiv Kumar Mazumdar, Faridabad (IN); Sankara Sri Venkata Ramakumar, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 16/294,771

(22) Filed: Mar. 6, 2019

(65) Prior Publication Data

US 2019/0276752 A1 Sep. 12, 2019

(30) Foreign Application Priority Data

Mar. 7, 2018 (IN) ..... 201821008448

(51) Int. Cl.

*C10G 65/04* (2006.01)
*C10G 67/02* (2006.01)
*C10G 65/16* (2006.01)
*C10G 65/00* (2006.01)

(52) U.S. Cl.

CPC ..... *C10G 67/02* (2013.01); *C10G 65/00* (2013.01); *C10G 65/04* (2013.01); *C10G 65/16* (2013.01); *C10G 2300/1055* (2013.01); *C10G 2300/202* (2013.01); *C10G 2300/207* (2013.01); *C10G 2300/301* (2013.01); *C10G 2300/307* (2013.01); *C10G 2400/04* (2013.01)

(58) Field of Classification Search

CPC ..... C10G 65/04; C10G 2300/202; C10G 2300/301; C10G 2400/04

See application file for complete search history.

(56) References Cited

U.S. PATENT DOCUMENTS

| | | | | |
|---|---|---|---|---|
| 5,985,136 | A | 11/1999 | Brignac et al. | |
| 6,013,598 | A | 1/2000 | Lapinski et al. | |
| 6,126,814 | A | 10/2000 | Lapinski et al. | |
| 8,002,967 | B2 * | 8/2011 | Hunter | C10G 65/02 208/89 |
| 9,005,430 | B2 * | 4/2015 | Fournier | C10G 49/007 208/78 |
| 2018/0370871 | A1 * | 12/2018 | Singh | B01D 3/14 |

* cited by examiner

*Primary Examiner* — Randy Boyer
(74) *Attorney, Agent, or Firm* — Maschoff Brennan

(57) ABSTRACT

The present invention relates to an assorted co-staging and counter stage hydro-treating process configuration scheme is disclosed for deep desulfurization and deep hydro-treating of diesel range hydrocarbons for obtaining diesel product having product sulfur less than 10 ppm and cetane number more than 51.

16 Claims, 3 Drawing Sheets

ASSORTED CO-STAGING AND COUNTER STAGING IN HYDROTREATING

FIELD OF THE INVENTION

The present invention relates to an innovative assorted co-staging and counter stage hydro-treating process configuration scheme for deep desulfurization and deep hydrotreating of diesel range hydrocarbons for obtaining diesel product.

BACKGROUND OF THE INVENTION

A full range diesel pool in refinery comprises of various streams from primary units such as crude & vacuum distillation units and secondary conversion units like FCC, visbreaker, resid FCC, delayed coker, etc. These various streams constitute varying concentrations of various organosulfur compounds and varying concentrations of paraffinic, naphthenic and aromatic compounds. The diesel specifications for sulfur and cetane number are the two major properties which are targeted to achieve by hydrotreating family of reactions. The hydrotreating reactions include hydrogenation, hydrogenolysis, isomerization associated with some undesired thermal and catalytic cracking leading to formation of coke and lighter hydrocarbons.

The sulfur compound species found in the diesel pool can be broadly categorized into two types namely: 'easy sulfur' type species and 'difficult or refractory sulfur' type species. The 'easy sulfur' species undergoes desulfurization in hydrotreating by hydrogenolysis reaction mechanism. The reaction is much faster and hence diesel streams constituting the easy sulfur species require lesser amount of catalyst volume per unit volume of feed per hour (i.e. less reaction time), lesser temperatures, and pressures. Also, the diesel streams constituting 'easy sulfur' are composed of higher paraffins and naphthenic compounds and lesser aromatic compounds. Hence, for cetane improvement of these streams one require again lesser amount of catalyst volume per unit volume of feed per hour (i.e. less reaction time), lesser temperatures, and pressures. On the other hand, the 'difficult or refractory sulfur' species needs to be first hydrogenated and then hydrogenolysis reaction. This reaction is slower and hence the diesel streams constituting the difficult or refractory sulfur species require higher amount of catalyst volume per unit volume of feed per hour (i.e. more reaction times), higher temperatures, and pressures. Also, the diesel streams constituting 'difficult or refractory sulfur' are composed of lesser paraffins and naphthenic compounds and higher aromatic compounds. Hence, for cetane improvement of these streams one require again higher amount of catalyst volume per unit volume of feed per hour (i.e. more reaction time), higher temperatures, and pressures.

It is known in the art that 'difficult or refractory sulfur' species and higher aromatics are relatively more concentrated in higher boiling part of full range straight run diesel streams. Further, the 'difficult or refractory sulfur' species are also present in the diesel range streams obtained from the secondary conversion units like FCC and delayed Coker units. The concentrations of aromatics are also high in these streams compared to the straight run diesel streams. Further, it is also known in the art that the diesel streams comprising higher concentrations of 'difficult or refractory sulfur' species contains not only higher concentrations of mono-aromatics but also higher concentrations of aromatics having two or more rings. These compounds require higher catalyst volumes i.e. more reaction time, and higher pressures and temperatures to 'treat' them effectively. The term 'treat' means removal for sulfur from sulfur species and deep saturation of aromatics.

U.S. Pat. Nos. 6,126,814, 6,013,598, and 5,985,136 discloses hydrodesulfurization processes, wherein the diesel with high sulfur content goes through two consecutive stages of hydrogen treatment: the first stage removes smaller sulfur compound molecules and thereafter the second stage removes larger molecules. In a typical two stage hydrodesulfurization process, the first stage operates at a temperature of about 300° C. and a pressure of about 44 barg. The high temperature and pressure is necessary to reduce the wetting barrier between solid, diesel, and hydrogen. The second stage operates at a temperature of about 400° C. and a pressure of about 58 barg. The higher temperature in the second stage is required to mitigate the higher resistance to mass transfer of the more stearically hindered sulfur compounds such as benzothiophenes, dibenzothiophenes, etc.

However, the hydrodesulfurization process not only reduces the amount of sulfur in the fuel, but also saturates olefins and reduces the amount of other heteroatom-containing compounds, including nitrogen-containing and oxygen-containing compounds in the fuel. Further the process also saturates the aromatic amount in the middle distillate, thereby improving the cetane number (an very important parameter) of the Diesel. It is widely known that the hydrodesulfurization reaction also involves some undesired thermal and catalytic cracking leading to formation of coke and lighter hydrocarbons and thereby generating unwanted dry gas (methane and ethane) and wild naphtha. These unwanted reactions in the hydrodesulfurization process can be minimized by optimizing the contact time of feed with catalyst. The optimization of contact time is also very vital to achieve ultra-low sulfur levels (below 10 ppmw) in the fuel. The reaction products formed due to hydrodesulfurization and other associated reaction also contains $H_2S$ and $NH_3$ having inhibition effect on the hydrodesulfurization reaction itself. However, the presence of optimum quantity of $H_2S$ in the reactor system is also very important for maintaining catalyst in active form. Therefore, appropriate staging effect is required to maintain only the optimum quantity of $H_2S$ in the reactor system.

Hence, it can be seen from the aforementioned that there remains a need in the art for an improved process for removing sulfur compounds from petroleum-based fuel that overcomes the deficiencies of the prior art.

The present invention provides a process configuration for deep desulfurization and deep hydrotreating of diesel range hydrocarbons to obtain diesel products by optimizing the contact time of feed with catalyst system and providing efficient staging effect. The efficient staging effect means maintaining optimum amount of $H_2S$ in the reactor, so as to reduce the inhibition effect due to $H_2S$ without hampering the catalyst activity.

SUMMARY OF THE INVENTION

The primary objective of the present invention is to provide an overall process configuration, which involves two stage hydrotreating with two hydrotreating zones in first stage of hydrotreating.

Another objective of the present invention is that the assortment of two stage hydrotreating in co- and counter-stage manner is done in such a way that the stream having difficult sulfur species is passed through both the hydrotreating zones of first hydrotreating stage and both the hydrotreating stages.

An embodiment of the present invention provides a co and counter stage hydrotreating process for deep desulfurization and deep hydro-treating of diesel range hydrocarbons, comprising:

(a) Segregating a full range diesel feed stream into first feed stream and second feed stream;

(b) Mixing and preheating the second feed stream with water and amine washed recycle hydrogen and passed through first hydrotreating zone of first stage hydrotreating to obtain an effluent;

(c) mixing the effluent obtained in step (b) with first feed stream and the recycle hydrogen and passed to second hydrotreating zone of first stage hydrotreating to obtain another effluent;

(d) separating the effluent obtained in step (c) in liquid part and gaseous part; wherein the gaseous part comprises of bulk of hydrogen with hydrogen sulfide and ammonia;

(e) cooling and washing the gaseous part obtained in step (d) with water and amine to obtain recycle hydrogen; wherein the recycle hydrogen comprises of bulk of hydrogen with reduced hydrogen sulphide and ammonia;

(f) recycling the recycle hydrogen obtained in step (e) to the first and the second hydrotreating zone of first stage hydrotreating;

(g) flashing the liquid part obtained in step (d) to obtain top flashed liquid and bottom flashed liquid;

(h) recovering the top flashed liquid obtained in step (g) as diesel product;

(i) dividing the bottom flashed liquid obtained in step (g) in first part and second part; wherein the first part is recovered as diesel product;

(j) mixing the second part obtained in step (i) with makeup hydrogen and passed to second stage hydrotreating to obtain an effluent;

(k) mixing the effluent obtained in step (j) with the second feed stream obtained in step (a).

An another embodiment of the present invention provides a co and counter stage hydrotreating process for deep desulfurization and deep hydro-treating of diesel range hydrocarbons, comprising:

(a) Segregating a full range diesel feed stream into first feed stream and second feed stream; wherein the first feed stream directly comes from crude and vacuum distillation units and the second feed stream directly comes from catalytic and thermal cracking units of FCC;

(b) mixing and preheating the second feed stream with water and amine washed recycle hydrogen and passed through first hydrotreating zone of first stage hydrotreating to obtain an effluent;

(c) mixing the effluent obtained in step (b) with first feed stream and the recycle hydrogen and passed to second hydrotreating zone of first stage hydrotreating to obtain another effluent;

(d) separating the effluent obtained in step (c) in liquid part and gaseous part; wherein the gaseous part comprises of bulk of hydrogen with hydrogen sulfide and ammonia;

(e) cooling and washing the gaseous part obtained in step (d) with water and amine to obtain recycle hydrogen; wherein the recycle hydrogen comprises of bulk of hydrogen with reduced hydrogen sulphide and ammonia;

(f) recycling the recycle hydrogen obtained in step (e) to the first and the second hydrotreating zone of first stage hydrotreating;

(g) flashing the liquid part obtained in step (d) to obtain top flashed liquid and bottom flashed liquid;

(h) recovering the top flashed liquid obtained in step (g) as diesel product;

(i) dividing the bottom flashed liquid obtained in step (g) in first part and second part; wherein the first part is recovered as diesel product;

(j) mixing the second part obtained in step (i) with make-up hydrogen and passed to second stage hydrotreating to obtain an effluent;

(k) mixing the effluent obtained in step (j) with the second feed stream obtained in step (a).

DESCRIPTION OF THE INVENTION

Figure 1:
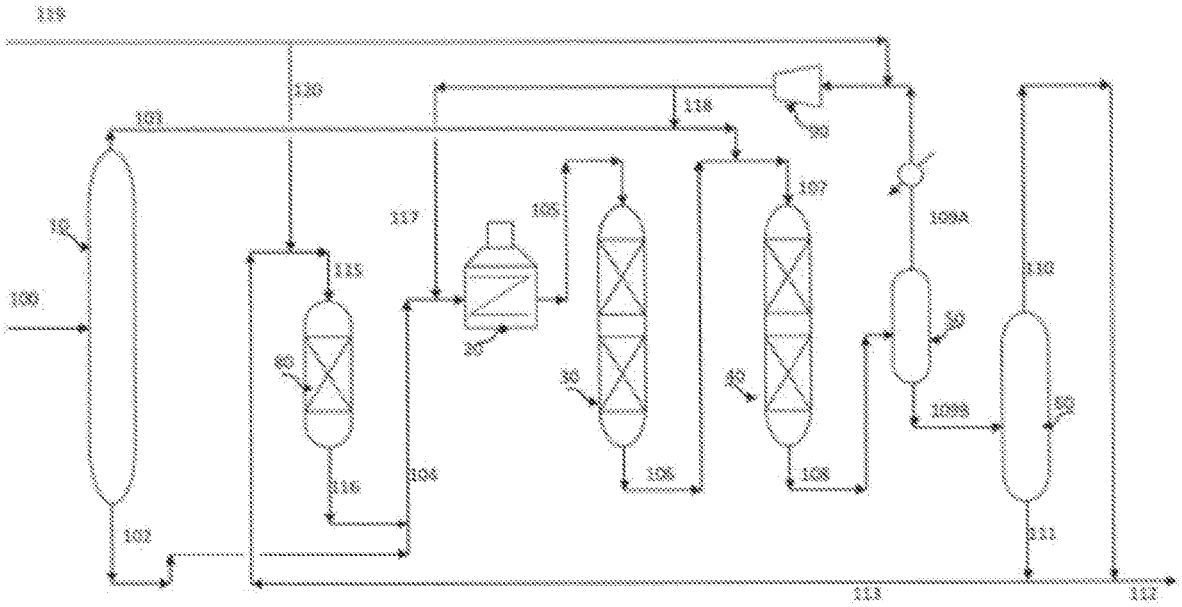
FIG. 1. Process scheme illustrating process configuration referring to main embodiment of the present invention FIG. 2. Process scheme illustrating variation of the process configuration of the present invention FIG. 3. Process scheme illustrating variation of the process configuration of the present invention FIG. 4. Process scheme illustrating variation of the process configuration of the present invention

While the invention is susceptible to various modifications and/or alternative processes and/or compositions, specific embodiment thereof has been shown by way of example in tables and will be described in detail below. It should be understood, however that it is not intended to limit the invention to the particular processes and/or compositions disclosed, but on the contrary, the invention is to cover all modifications, equivalents, and alternative falling within the spirit and the scope of the invention as defined by the appended claims.

The tables and protocols have been represented where appropriate by conventional representations, showing only those specific details that are pertinent to understanding the embodiments of the present invention so as not to obscure the disclosure with details that will be readily apparent to those of ordinary skill in the art having benefit of the description herein.

The following description is of exemplary embodiments only and is NOT intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention.

Any particular and all details set forth herein are used in the context of some embodiments and therefore should NOT be necessarily taken as limiting factors to the attached claims. The attached claims and their legal equivalents can be realized in the context of embodiments other than the ones used as illustrative examples in the description below.

According to a main embodiment, the present invention provides a co and counter stage hydrotreating process for deep desulfurization and deep hydro-treating of diesel range hydrocarbons, comprising:

(a) Segregating a full range diesel feed stream into first feed stream and second feed stream;

(b) Mixing and preheating the second feed stream with water and amine washed recycle hydrogen and passed through first hydrotreating zone of first stage hydrotreating to obtain an effluent;

(c) mixing the effluent obtained in step (b) with first feed stream and the recycle hydrogen and passed to second hydrotreating zone of first stage hydrotreating to obtain another effluent;

(d) separating the effluent obtained in step (c) in liquid part and gaseous part; wherein the gaseous part comprises of bulk of hydrogen with hydrogen sulfide and ammonia;

(e) cooling and washing the gaseous part obtained in step (d) with water and amine to obtain recycle hydrogen; wherein the recycle hydrogen comprises of bulk of hydrogen with reduced hydrogen sulphide and ammonia;

(f) recycling the recycle hydrogen obtained in step (e) to the first and the second hydrotreating zone of first stage hydrotreating;

(g) flashing the liquid part obtained in step (d) to obtain top flashed liquid and bottom flashed liquid;

(h) recovering the top flashed liquid obtained in step (g) as diesel product;

(i) dividing the bottom flashed liquid obtained in step (g) in first part and second part; wherein the first part is recovered as diesel product;

(j) mixing the second part obtained in step (i) with make-up hydrogen and passed to second stage hydrotreating to obtain an effluent;

(k) mixing the effluent obtained in step (j) with the second feed stream obtained in step (a);

According to a preferred embodiment, the present invention provides a co and counter stage hydrotreating process for deep desulfurization and deep hydro-treating of diesel range hydrocarbons, comprising:

(a) Segregating a full range diesel feed stream into first feed stream and second feed stream; wherein the first feed stream directly comes from crude and vacuum distillation units and the second feed stream directly comes from catalytic and thermal cracking units of FCC;

(b) mixing and preheating the second feed stream with water and amine washed recycle hydrogen and passed through first hydrotreating zone of first stage hydrotreating to obtain an effluent;

(c) mixing the effluent obtained in step (b) with first feed stream and the recycle hydrogen and passed to second hydrotreating zone of first stage hydrotreating to obtain another effluent;

(d) separating the effluent obtained in step (c) in liquid part and gaseous part; wherein the gaseous part comprises of bulk of hydrogen with hydrogen sulfide and ammonia;

(e) cooling and washing the gaseous part obtained in step (d) with water and amine to obtain recycle hydrogen; wherein the recycle hydrogen comprises of bulk of hydrogen with reduced hydrogen sulphide and ammonia;

(f) recycling the recycle hydrogen obtained in step (e) to the first and the second hydrotreating zone of first stage hydrotreating;

(g) flashing the liquid part obtained in step (d) to obtain top flashed liquid and bottom flashed liquid;

(h) recovering the top flashed liquid obtained in step (g) as diesel product;

(i) dividing the bottom flashed liquid obtained in step (g) in first part and second part; wherein the first part is recovered as diesel product;

(j) mixing the second part obtained in step (i) with make-up hydrogen and passed to second stage hydrotreating to obtain an effluent;

(k) mixing the effluent obtained in step (j) with the second feed stream obtained in step (a).

According to a preferred feature of the present invention, the first feed stream has boiling point in the range of 200 to 320° C. and the second feed stream has boiling point in the range of 320 to 390° C. The segregation of the first feed stream and the second feed stream is carried out by distillation technique.

According to a feature of the present invention, the types of sulfur compounds are of two types: the easy sulfur species and difficult or refractory sulfur species. The full range diesel is cut in two different distinct cuts depending on the distribution of these sulfur species. The making of two feed streams as two distinct cuts is aimed at concentrating majority of easy sulfur species in first feed stream and concentrating difficult or refractory sulfur species in second feed stream. Therefore, the boiling ranges for the said two feed streams are indicative only and can vary depending on the type, concentrations and distribution of these easy and difficult sulfur species in full range diesel. In general, easy sulfur is made up of compounds which are readily hydrodesulfurized and boil below about 320° C., while refractory sulfur is made up of compounds which need hydrogenation before removal.

According to another feature of the present invention, the first feed stream comprises of easy sulfur species and the second feed stream comprises of difficult and refractory sulfur species.

While dividing the full range diesel in two distinct feed streams according to type of sulfur species, it is essential for concentrating the majority of aromatics compounds including benzocycloparaffins and multi-ring aromatics in the second feed stream. This is because these compounds need more catalyst volumes (more reaction time), higher operating conditions of temperature and pressure to obtain a diesel product of improved cetane by deep saturation of all types of aromatic compounds. The second feed stream is more aromatic rich stream as compared to first feed stream which lean in aromatics.

According to yet another feature of the present invention, the full range diesel boiling range hydrocarbon feedstock have the boiling range between 200 to 390° C. with sulfur concentration in the range of 0.5 to 3.0 wt %. Further, the overall liquid hourly space velocity (LHSV) maintained is in the range of 0.3 to 4.0 h−1.

According to an embodiment of the present invention, the first and the second hydrotreating zones of the first stage hydrotreating and the second stage hydrotreating operate at a temperature in the range of 250 to 450° C. and pressure in the range of 20 to 250 barg. In addition, the first and the second hydrotreating zones of the first stage hydrotreating and the second stage hydrotreating operate with hydrogen to oil ratios in the range of 50 to 2000 $Nm^3/m^3$.

According to a feature of the present invention, the recycled hydrogen is obtained in step (b) from a Hot HPS and the effluent obtained in step (c) is separated in the Hot HPS. The Hot HPS is operated at the temperature and pressure of the effluent of the first stage hydrotreating.

According to another feature of the present invention, the flashing of liquid in step (g) takes place in a flash drum, wherein the flash drum is operated at a pressure lower by 20 to 30 bar than the Hot HPS pressure. Further, the flashing takes place at a pressure such that the refractory sulfur and unsaturated aromatic compounds are concentrated in the bottom flashed liquid.

According to an additional feature of the present invention, the bottom flashed liquid comprises of 5 to 50 wt % of the full range diesel feed. In addition, the second feed stream comprises of 0 to 60 wt % of the bottom flashed liquid.

According to a preferred feature of the present invention, the diesel product obtained comprises of sulfur content less of than 10 ppm and cetane number above 51.

According to another feature of the present invention, the total sulfur content of the full range diesel is dependent on the crude being processed in a refinery. Generally, it is found to be between 0.1 to 2.5 wt %, more commonly between 0.5 to 2.0 wt %. The said easy sulfur species generally comprises 50 to 80 wt % (more commonly 60 to 70 wt %) of the total sulfur species found in the diesel range feed. The said first feed stream (103) is generally 50 to 80 wt % of the total full range diesel (100) and the said second feed stream (102) generally 20 to 40 wt % of the total full range diesel (100).

According to yet another feature of the present invention, the cetane number of the straight run diesel feed streams forming part the total full range diesel pool is generally around 40 to 45, while the cetane number of the diesel range feed streams (called cracked stocks) coming from the secondary conversion units like FCC, delayed coker can be below 25. The total cracked stocks can comprise 40 to 60 wt % of total full range diesel pool in a given refinery. The cetane number of cracked stocks is very low owing to their higher concentrations of aromatics compounds. Therefore, these aromatics compounds also need to be deeply saturated to enhance the cetane number of total diesel pool. Generally, the cetane number of total full range diesel pool can be found in the range between 30 to 40 depending on the crude being processed and weight percentage of cracked stocks in the diesel pool.

According to a main embodiment of the present invention referring to FIG. 1, a full range diesel pool stream (100) of boiling point in the range of 200 to 390° C. is sent to distillation column (10) where it is split in to two distinct streams. The first stream taken out from the top has boiling point between 200 to 320° C. and is called first feed stream (103) and the second stream taken out from the bottom has boiling point between 320 to 390° C. and is called second feed stream (102). The full range diesel with boiling point between 200 to 390° C. is formed by combining the various streams that are coming from various source units in a refinery. These streams may be straight run hydrocarbons from primary units of a refinery i.e. crude distillation unit or from secondary conversion units, such as FCC, resid FCC, visbreaker, Delayed Coker units. The streams may also be cracked stocks from the secondary conversion units. The type and concentrations of sulfur and nitrogen compounds and paraffins, naphthenes, and aromatics compounds in full range diesel depend on the type of crude being processed and severity and operation of various secondary units in a refinery.

The said second feed stream (102) is mixed with effluent (116) from the second stage hydrotreating and this mixed stream (104) is mixed again with recycle hydrogen (117) and preheated in a heater (20). This preheated mixed stream (105) is sent to first hydrotreating zone (30) of first stage hydrotreating and effluent (106) is obtained. The operating conditions maintained in the first hydrotreating zone (30) of first stage hydrotreating are conventional hydrotreating conditions: the temperature of catalyst bed is in the range of 250 to 450° C., more preferably 340 to 400° C. The pressure maintained is in the range of 20 to 250 barg, more preferably in the range of 70 to 150 barg and hydrogen to oil ratio is in the range of 50 to 2000 $Nm^3/m^3$, more preferably in the range of 200 to 600 $Nm^3/m^3$.

According to an embodiment of the present invention, the operating conditions can be tuned depending on the type of feed (105) being processed and depending on the operating conditions being maintained in the second stage hydrotreating (80). The operating conditions are tuned to target the sulfur content of liquid fraction of all gases and liquids being passed through the said hydrotreating zone (30) to reduce below 10 ppm and to achieve maximum cetane gain by deep saturation of aromatics.

According to another feature of the present invention, the catalyst used in the first hydrotreating zone of first stage hydrotreating (30) may be any suitable conventional NiMo catalyst active in sulfided form. Any other catalyst system which is active in sulfided form may also be used. The present invention is able to utilize the conventional catalyst system in the first hydrotreating zone (30) and still capable of obtaining better quality products in terms of sulfur content and cetane number. The volume of the catalyst bed in the first hydrotreating zone (30) is selected such that to maintain the liquid hourly space velocity of 1.0 to 3.5 $h^{-1}$ in this zone.

The quench hydrogen is added at suitable places in this first hydrotreating zone (30) of first stage hydrotreating. The conventional practices known in the art can be applied here to control the temperature rise in the zone (30) below 30° C., more preferably below 20° C.

The effluent (106) from the first hydrotreating zone (30) of first stage hydrotreating is mixed with first feed stream (103) and recycle hydrogen (118) to obtain mixed stream (107). This mixed stream (107) is sent to second hydrotreating zone (40) of first stage hydrotreating and effluent (108) is obtained. The second hydrotreating zone (40) of first stage hydrotreating is meant to process the first feed stream (103) comprised of easy sulfur species and low aromatics content and deeply desulfurized and dearomatized effluent (106) from first hydrotreating zone (30) is also being processed to provide the extra catalyst volume to this stream (106) having difficult sulfur species. Since this second hydrotreating zone (40) of first stage hydrotreating is the catalyst zone which is processing total quantity of full range diesel feed, the catalyst volume is selected in such way that it should give a liquid hourly space velocity of 0.5 to 1.5 $h^{-1}$. The other operating conditions of temperature and pressure are: the temperature of catalyst bed is in the range of 250 to 450° C., more preferably 340 to 400° C.; the pressure maintained is in the range of 20 to 250 barg, more preferably in the range of 70 to 150 barg and hydrogen to oil ratio is in the range of 50 to 2000 $Nm^3/m^3$, more preferably in the range of 200 to 600 $Nm^3/m^3$.

The catalyst used in the second hydrotreating zone of first stage hydrotreating (40) can be any suitable conventional Ni-Mo catalyst active in sulfided form. Any other catalyst system which is active in sulfided form can also be used. The quench hydrogen is added at suitable places in this first hydrotreating zone (30) of first stage hydrotreating. The conventional practices known in the art can be applied here to control the temperature rise in the zone (40) below 40° C., more preferably below 30° C.

The effluent (108) from second hydrotreating zone (40) of first stage hydrotreating is sent to Hot HPS (Hot High Pressure Separator) (50) without cooling and depressurizing. In this Hot HPS (50), the effluent (108) is separated in gas (109A) and liquid (109B) parts. The gases, which mainly consists of hydrogen along with minor quantities of hydrogen sulfide and ammonia are cooled, water washed and then amine washed and repressurized in recycle gas compressor (90) for recycling.

The liquid (109B) of Hot HPS (50) is sent to flash drum (60). The flash drum (60) is operated at slightly lower pressure as that of liquid (109B) from Hot HPS. Some pressure drop is imparted by controlling the top pressure of flash drum (60). In flash drum, the liquid (109B) from Hot HPS (50) is flashed and divided in two parts: the top part (110) and the bottom part (111). The top part (110) is cooled and recovered as diesel product. The some of the bottom part (111) of liquid is also collected (112), cooled and recovered as diesel product by mixing with top part (110) of liquid from flash drum (60). The diesel product (112) thus obtained may stripped off any residual hydrogen sulfide and ammonia before sending it to storage.

The flashing in flash drum (60) is done in such way that bottom part (111) of liquid obtained is boiling in the range of 320 to 390° C., so that majority of unconverted refractory sulfur species and majority of unsaturated multi-ring aromatics are recovered in bottom part (111) of liquid. It is important here to mention that a flash drum (60) is used to divide the effluent liquid (109B) in two parts. This is done to ensure that some of the hydrogen sulfide from effluent liquid (109B) from Hot HPS (50) also ends up in this bottom part. If distillation or stripper (reboiler or steam type) were used, there will be no hydrogen sulfide left in the bottom part (111) of liquid from flash drum (60). This hydrogen sulfide in some predetermined concentrations in bottom part (111) of liquid from flash drum (60) is important and it has a major role to play in the second stage hydrotreating (80), as discussed above.

Some part of the bottom part (111) of liquid is used as a second stage feed (113). The quantity of this stream is depend on the various factors such as type of the full range diesel being processed, the quantity of the fraction of full range diesel (in liquid effluent Hot HPS) having refractory sulfur species, and the aromatics concentration in this fraction. According to these properties, the extent of flashing is controlled by controlling the pressure of flash drum (60). The extent of flashing thus decides the quantity of bottom part (111) required to be processed in the second stage hydrotreating (80). Generally, the flashing operation is carried out by controlling the pressure of the flash drum (80) in such a way that about 60 to 80 wt % of the liquid is flashed off from the liquid effluent (109B) of the Hot HPS (50). The pressure required for this extent of flashing is commonly 20 to 30 barg lower than the pressure in the Hot HPS (50). The part of the bottom part (111) which is required to be processed in the second stage hydrotreating (80) is in the range of 0 to 60 wt % of the bottom part (111) of the flash drum (60), more preferably the part of the bottom part (111) which is required to be processed in the second stage hydrotreating (80) is in the range of 20 to 40 wt %.

Some of the bottom part (111) of liquid is used as a second stage feed (113) and is mixed with makeup hydrogen (120) and this mixed stream (115) sent to second stage hydrotreating (80). In second stage hydrotreating (80) and effluent (116) is obtained. It is quiet pertinent here to mention that some part of the effluent (116) from the second stage hydrotreating (80) can be directly sent to Hot HPS (50) to avoid inert compounds build up in the system.

The second stage hydrotreating (80) is important step in the present invention. The second stage feed (113) is the bottom part of product of both zones of first stage hydrotreating (30 and 40). The makeup hydrogen (120) required for all the processing is entering in the system in second stage hydrotreating (80). The second stage hydrotreating (80) is operated at pressures about 10 to 20 bar higher than the both zones of first stage hydrotreating. The increased pressure may be achieved by using a pump to enhance the pressure of second stage feed (113) before it mixed with makeup hydrogen. Since makeup hydrogen (120) is coming to second stage hydrotreating (80), the hydrogen is devoid of any hydrogen sulfide required to maintain the catalyst system of second stage hydrotreating (80) in sulfide state, therefore, it is important to have some hydrogen sulfide in dissolved state from first stage hydrotreating. Further, the hydrogen sulfide is beneficial in effecting the deeper aromatics saturation and hence enhanced cetane number than the conventional second stage hydrotreating scheme, which do not use hydrogen sulfide in dissolved state but employs it from the recycle gas.

Since make up hydrogen being used in the second stage hydrotreating (80), it can impart more hydrogen partial pressures at any given total system pressure, than using the recycle gas which will have hydrogen sulfide and some lighter hydrocarbon up to carbon number 6. The lighter hydrocarbons are not present in the hydrogen of the second stage hydrotreating, thus giving still more effective hydrogen partial pressure in second stage hydrotreating (80), resulting in deeper aromatics saturation and further deeper removal of refractory sulfur species.

The other operating conditions in the second stage hydrotreating (80) are: the temperature of catalyst bed is in the range of 250 to 450° C., more preferably in the range of 320 to 380° C.; and hydrogen to oil ratio is in the range of 50 to 2000 $Nm^3/m^3$, more preferably in the range of 200 to 600 $Nm^3/m^3$. The liquid hourly space velocity is maintained in the range of 0.5 to 4.0 $h^{-1}$. Since the catalyst in the second stage hydrotreating (80) is required to process the least quantity of liquid per hour, its catalyst volume will be least of all the three catalysts (first and second hydrotreating zones of first stage hydrotreating and second stage hydrotreating). The overall (combining all the catalysts of all the stages) liquid hourly space velocity is in the range of 0.3 to 4.0 $h^{-1}$.

The effluent (116) from the second stage hydrotreating is mixed with second feed stream (102) and mixed with recycle hydrogen (117) and preheated and sent to first hydrotreating zone of first stage hydrotreating.

Figure 2:
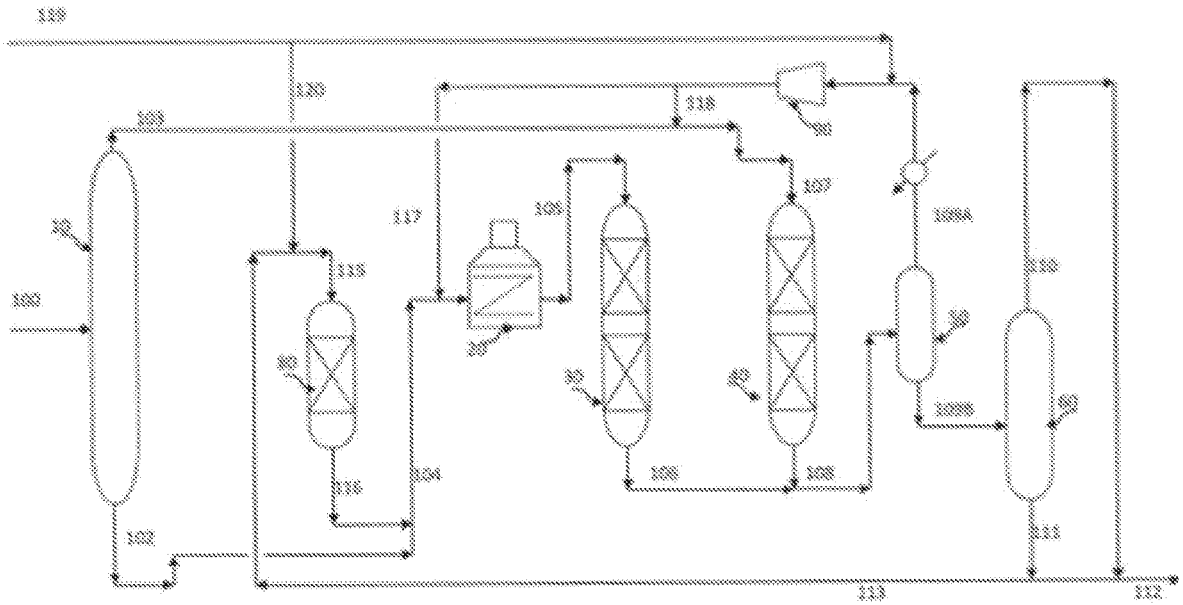

Other possible variation in the process configuration of present invention is discussed below:

According to another embodiment of the present invention referring to FIG. 2, it is possible to segregate the different streams before forming the part of full range diesel pool. As discussed above, all the straight run streams boiling below 320° C. can be grouped together to form the said first feed stream (103). All the straight run streams boiling above 320° C. and all the diesel range streams boiling between 200 to 390° C. may be collected together to form the said second feed stream (102). As discussed above, the formed two feed streams also display the same properties in terms of type of sulfur species (easy or difficult) and the type of aromatic compounds in the said two feed streams. In every possible application of the present invention, the possibility of segregation of feed streams forming the part of total diesel pool may be explored, before trying to combine them all together and then distilling them as discussed in the discussion of process scheme of FIG. 1. Such a segregation results in considerable savings in capital and operating expenditures as compared to the process scheme of FIG. 1. Rest of the process configuration and process scheme of present invention in FIG. 2 is exactly same as in FIG. 1 and still maintaining the assortment of co- and counter/reverse staging exactly same as in FIG. 1.

Figure 3:
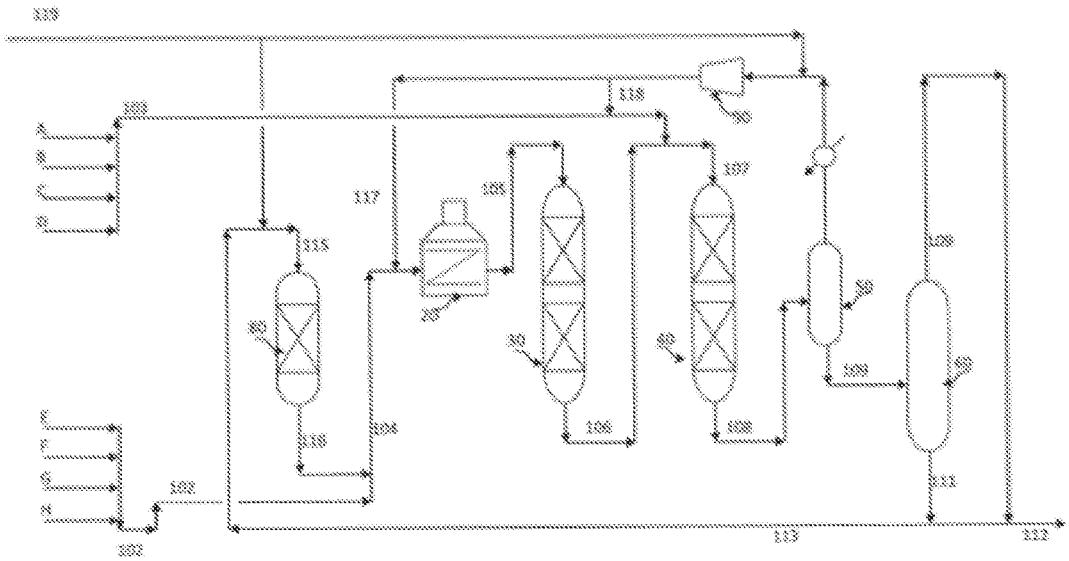

According to yet another embodiment of the present invention referring to FIG. 3, the effluent (106) from the first hydrotreating zone (30) of first stage hydrotreating is mixed with effluent (108) from the second hydrotreating zone (40) of first stage hydrotreating and sent to Hot HPS (50). This variation makes both the (first and second) hydrotreating zones (30 & 40) of first stage hydrotreating as parallel processing zones for the difficult sulfur species containing second feed stream (102) processing in first hydrotreating zone (30) of first stage hydrotreating along with the effluent (116) from second stage hydrotreating (80) and easy sulfur species containing first feed stream (103) processing in second hydrotreating zone (40) of first stage hydrotreating. Due to the parallel processing the volumes of catalysts required in both the hydrotreating zones (first and second) are different from the processing scheme of FIG. 1. The scheme allows more flexibility in operating conditions to be maintained in the two parallel processing zones of first stage hydrotreating. Rest of the process configuration and process scheme of present invention in FIG. 3 is exactly same as in FIG. 1 and still maintaining the assortment of co- and counter/reverse staging exactly same as in FIG. 1.

Figure 4:
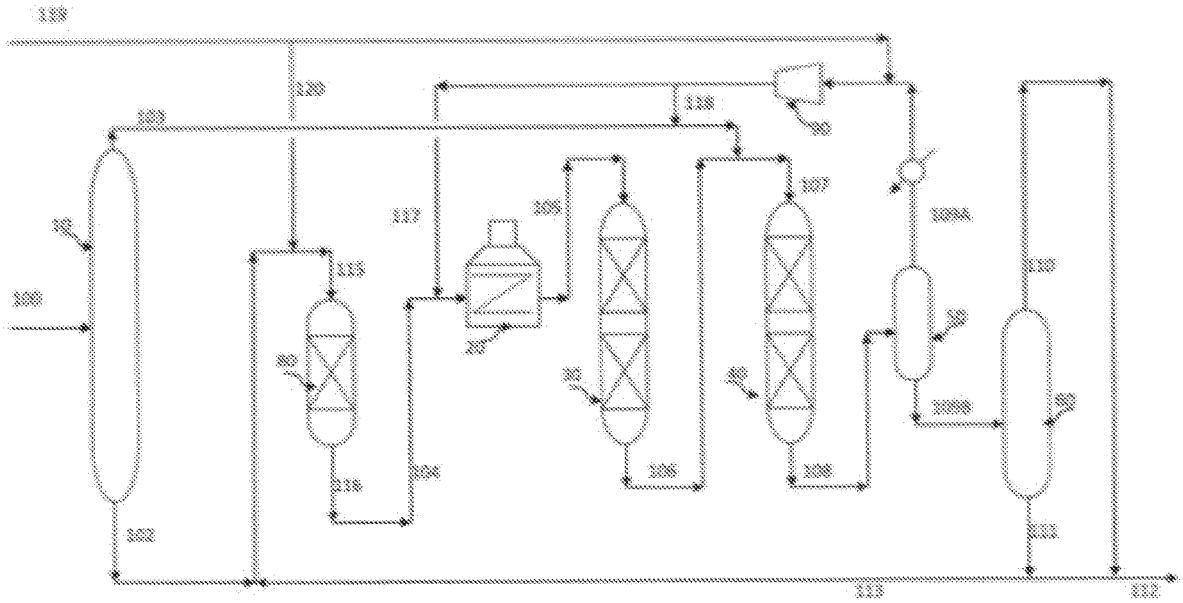

According to another embodiment of the present invention referring to FIG. 4, the said second feed stream (102) and the some of the bottom part (113) of the flash drum (60) may be mixed with makeup hydrogen and sent to second stage hydrotreating (80) and effluent (116) is obtained. The effluent may be combined with recycle hydrogen, heated and sent to first hydrotreating zone (30) of first stage hydrotreating. Rest of the process configuration remains same as in FIG. 1. The advantage here is that all of the difficult or refractory sulfur species containing streams, i.e. the said second feed stream (102) and the said bottom part (113) flash drum (60) are processed in longest catalyst bed path length possible under the present invention's process configuration and still maintaining the assortment of co- and counter/reverse staging exactly same as in FIG. 1.

The present invention provides that by utilizing the part of the hydrogen sulfide formed in first stage can be effectively used to keep the catalyst of second stage hydrotreating (80) in sulfided state while processing with makeup hydrogen (which is devoid of any hydrogen sulfide). The hydrogen sulfide also helps in increasing the efficiency of deep hydrogenation reactions occurring in second stage hydrotreating (80). Therefore, by sending the second stage hydrotreating (80) effluent (116) to first hydrotreating zone (30) of first stage hydrotreating following innovative benefits are obtained:

a. first one, to provide immediate presence of hydrogen sulfide at sufficiently higher concentration in liquid hydrocarbons to keep the catalyst of first hydrotreating zone of first stage hydrotreating in sulfided form;
b. second one, to provide higher concentrations of hydrogen in dissolved form in liquids being processed in first hydrotreating zone of first stage hydrotreating and these liquids require higher hydrogen quantities to deeply saturate the multi-ring aromatic compounds and to deeply saturate and remove sulfur from 'difficult or refractory sulfur' species;
c. and the third one, to provide yet higher hydrogen availability by providing the higher concentrations of hydrogen donor compounds which are continuously getting generated in second stage hydrotreating; and
d. and the fourth one, to provide solvent and hence increasing the mobility of multi-ring aromatic compounds and 'difficult or refractory sulfur' species in first hydrotreating zone of first stage hydrotreating and hence efficiency of catalyst.

We claim:

1. A co and counter stage hydrotreating process for deep desulfurization and deep hydro-treating of diesel range hydrocarbons, comprising:

(a) segregating a full range diesel feed stream into a first feed stream and a second feed stream;
(b) mixing and preheating the second feed stream with water and amine washed recycle hydrogen and passing through a first hydrotreating zone of a first stage hydrotreating to obtain an effluent;
(c) mixing the effluent obtained in step (b) with the first feed stream and the recycle hydrogen and passed to a second hydrotreating zone of the first stage hydrotreating to obtain an another effluent;
(d) separating the effluent obtained in step (c) in a liquid part and a gaseous part; wherein the gaseous part comprises of bulk of hydrogen with hydrogen sulfide and ammonia;
(e) cooling and washing the gaseous part obtained in step (d) with water and amine to obtain recycle hydrogen; wherein the recycle hydrogen comprises of bulk of hydrogen with reduced hydrogen sulphide and ammonia;
(f) recycling the recycle hydrogen obtained in step (e) to the first and the second hydrotreating zone of the first stage hydrotreating;
(g) flashing the liquid part obtained in step (d) to obtain a top flashed liquid and a bottom flashed liquid;
(h) recovering the top flashed liquid obtained in step (g) as diesel product;
(i) dividing the bottom flashed liquid obtained in step (g) in a first part and a second part; wherein the first part is recovered as diesel product;
(j) mixing the second part obtained in step (i) with make-up hydrogen and passed to a second stage hydrotreating to obtain another effluent;
(k) mixing the effluent obtained in step (j) with the second feed stream obtained in step (a).

2. A co and counter stage hydrotreating process for deep desulfurization and deep hydro-treating of diesel range hydrocarbons, comprising:

(a) segregating a full range diesel feed stream into a first feed stream and a second feed stream; wherein the first feed stream directly comes from crude and vacuum distillation units and the second feed stream directly comes from catalytic and thermal cracking units of FCC;
(b) mixing and preheating the second feed stream with water and amine washed recycle hydrogen and passing through a first hydrotreating zone of a first stage hydrotreating to obtain an effluent;
(c) mixing the effluent obtained in step (b) with the first feed stream and the recycle hydrogen and passed to a second hydrotreating zone of the first stage hydrotreating to obtain an another effluent;
(d) separating the effluent obtained in step (c) in a liquid part and a gaseous part;
wherein the gaseous part comprises of bulk of hydrogen with hydrogen sulfide and ammonia;
(e) cooling and washing the gaseous part obtained in step (d) with water and amine to obtain recycle hydrogen;

wherein the recycle hydrogen comprises of bulk of hydrogen with reduced hydrogen sulphide and ammonia;

(f) recycling the recycle hydrogen obtained in step (e) to the first and the second hydrotreating zone of the first stage hydrotreating;

(g) flashing the liquid part obtained in step (d) to obtain a top flashed liquid and a bottom flashed liquid;

(h) recovering the top flashed liquid obtained in step (g) as diesel product;

(i) dividing the bottom flashed liquid obtained in step (g) in a first part and a second part; wherein the first part is recovered as diesel product;

(j) mixing the second part obtained in step (i) with make-up hydrogen and passed to a second stage hydrotreating to obtain an effluent;

(k) mixing the effluent obtained in step (j) with the second feed stream obtained in step (a).

3. The process as claimed in claim 1, wherein the first feed stream has boiling point in the range of 200 to 320° C. and the second feed stream has boiling point in the range of 320 to 390° C.

4. The process as claimed in claim 1, wherein the segregation of the first feed stream and the second feed stream is carried out by distillation technique.

5. The process as claimed in claim 1, wherein the first feed stream comprises easy sulfur species and the second feed stream comprises difficult and refractory sulfur species.

6. The process as claimed in claim 1, wherein the full range diesel feed stream has boiling point in the range of 200 to 390° C. with sulfur concentration in the range of 0.5 to 3.0 wt %.

7. The process as claimed in claim 1, wherein the overall LHSV in the first stage and the second stage hydrotreating is maintained in the range of 0.3 to $4.0^{-1}$.

8. The process as claimed in claim 1, wherein the first and the second hydrotreating zones of the first stage hydrotreating and the second stage hydrotreating operate at a temperature in the range of 250 to 450° C. and pressure in the range of 20 to 250 barg.

9. The process as claimed in claim 1, wherein the first and the second hydrotreating zones of the first stage hydrotreating and the second stage hydrotreating operate with hydrogen to oil ratios in the range of 50 to 2000 $Nm^3/m^3$.

10. The process as claimed in claim 1, wherein the recycled hydrogen is obtained in step (b) from a Hot HPS and the effluent obtained in step (c) is separated in the Hot HPS.

11. The process as claimed in claim 10, wherein the Hot HPS is operated at the temperature and pressure of the effluent of the first stage hydrotreating.

12. The process as claimed in claim 1, wherein the flashing of liquid in step (g) takes place in a flash drum, wherein the flash drum is operated at a pressure lower by 20 to 30 bar than the Hot HPS pressure.

13. The process as claimed in claim 1, wherein the flashing takes place at a pressure such that refractory sulfur and unsaturated aromatic compounds are concentrated in the bottom flashed liquid.

14. The process as claimed in claim 1, wherein the bottom flashed liquid comprises 5 to 50 wt % of the full range diesel feed.

15. The process as claimed in claim 1, wherein the second feed stream comprises 0 to 60 wt % of the bottom flashed liquid.

16. The process as claimed in claim 1, wherein the diesel product comprises sulfur content less of than 10 ppm and cetane number above 51.

* * * * *